United States Patent [19]

Farmer et al.

[11] 4,191,276

[45] Mar. 4, 1980

[54] HIGH-VISIBILITY TWO-STAGE MAST ASSEMBLY FOR LIFT TRUCKS

[75] Inventors: Stanley E. Farmer, Troutdale; Harlan D. Olson, Sandy, both of Oreg.

[73] Assignee: Cascade Corporation, Portland, Oreg.

[21] Appl. No.: 884,005

[22] Filed: Mar. 6, 1978

[51] Int. Cl.[2] ..... B66F 9/06

[52] U.S. Cl. ..... 187/9 E

[58] Field of Search ..... 187/9 E

[56] References Cited

U.S. PATENT DOCUMENTS

| | | | |
|---|---|---|---|
| 2,349,352 | 5/1944 | Johnson | 187/9 E |
| 3,116,812 | 1/1964 | Farmer | 187/9 E |
| 3,213,967 | 10/1965 | Hastings et al. | 187/9 E |
| 3,338,335 | 8/1967 | McNeeley | 187/9 E |
| 4,030,568 | 6/1977 | Heinold | 187/9 E |

FOREIGN PATENT DOCUMENTS

| | | | |
|---|---|---|---|
| 1001945 | 1/1957 | Fed. Rep. of Germany | 187/9 E |

*Primary Examiner*—Jeffrey V. Nase

*Attorney, Agent, or Firm*—Chernoff & Vilhauer

[57] ABSTRACT

A high visibility telescopic mast assembly for lift trucks having a pair of mutually reciprocable mast sections, a load carriage movably mounted thereon and a fluid actuated extensible-contractable fluid ram assembly for selectively lifting the load carriage and one of the mast sections with respect to the other mast section. The fluid ram assembly is mounted centrally between the uprights of the respective mast sections and is contractable to a height adjacent the longitudinal midpoint of the fully contracted mast so as to provide relatively unimpeded visibility over the top of the ram assembly between the uprights when the mast is contracted. The ram assembly is connected to the extensible mast section in such a way that the ram begins to lift the mast section at a speed identical to the speed of ram extension while the ram assembly is still substantially fully contracted. Two alternative embodiments of the invention are disclosed, one featuring no free-lift and one featuring partial free-lift of the load carriage.

7 Claims, 14 Drawing Figures

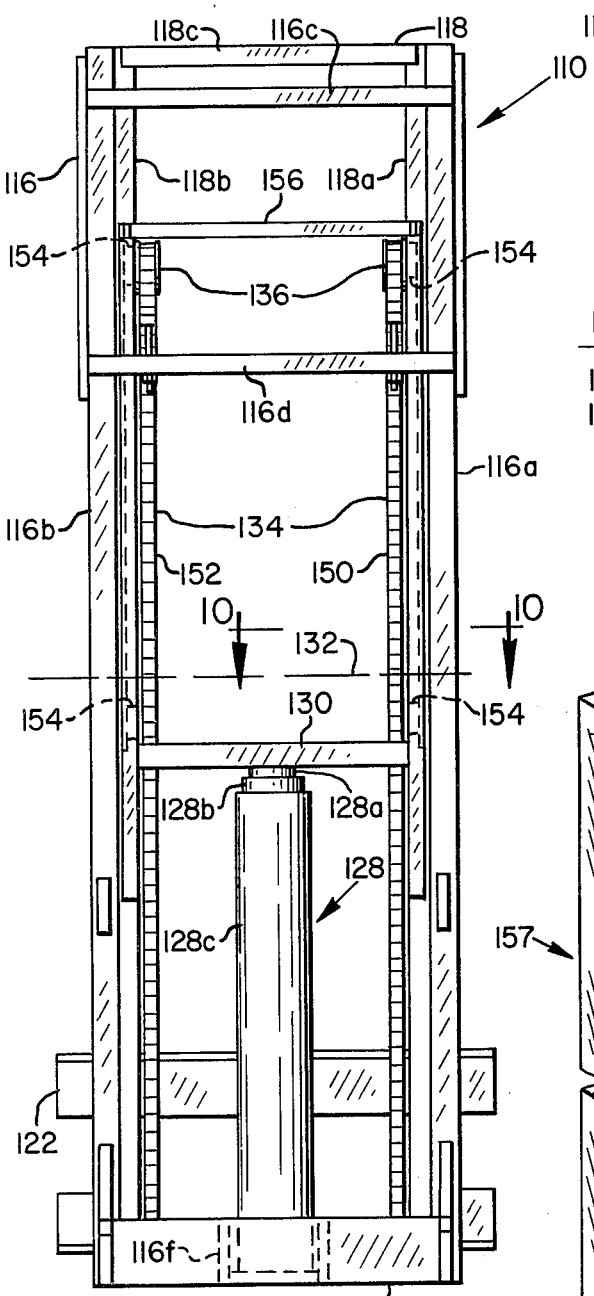
FIG. 7
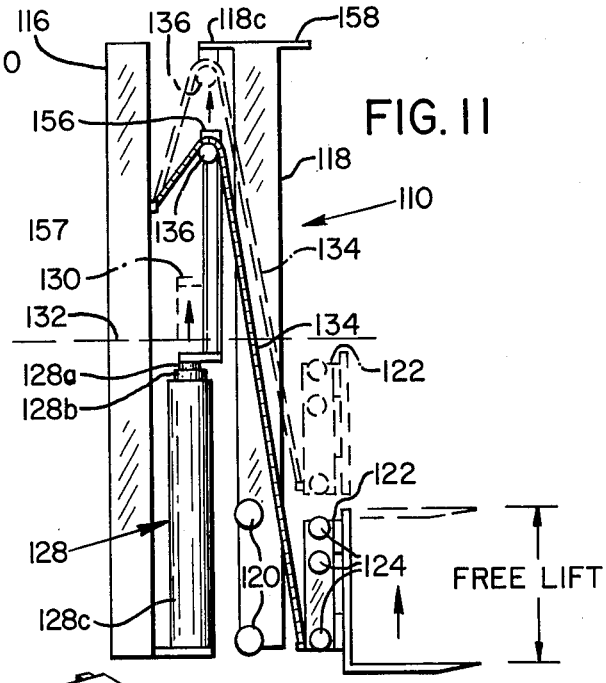
FIG. 11
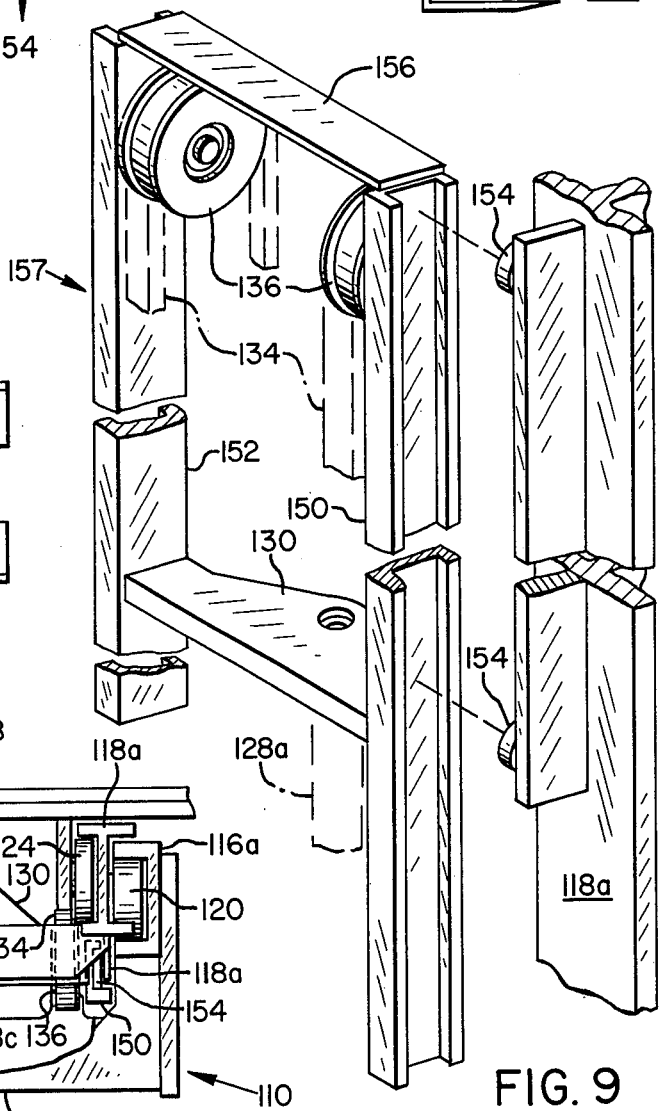
FIG. 9
FIG. 8
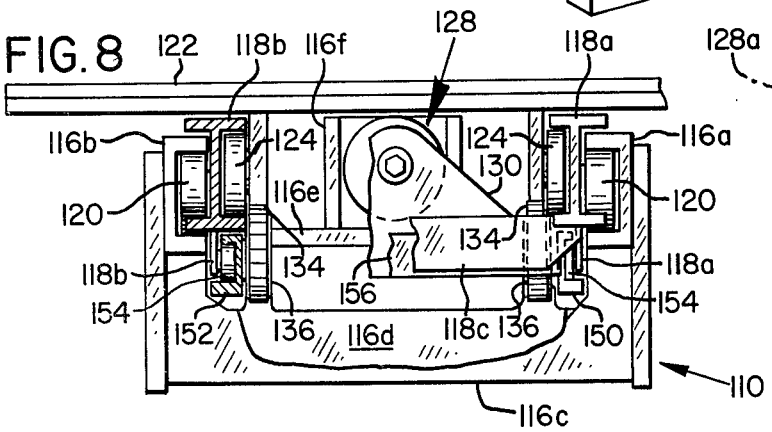

HIGH-VISIBILITY TWO-STAGE MAST ASSEMBLY FOR LIFT TRUCKS

BACKGROUND OF THE INVENTION

This invention relates to improvements in two-stage mast assemblies for lift trucks. More particularly the invention relates to a two-stage mast which provides a high degree of forward visibility for the lift truck operator while the truck is traveling with the load carriage substantially lowered and the mast substantially fully contracted.

One of the most common deficiencies of industrial lift trucks having telescopic masts at their forward ends is the problem of impaired operator forward visibility during travel of the lift truck with the load carriage in a substantially lowered position. In the environment where such trucks operate, a load is normally picked up at one location, lowered to a traveling position a few inches above the ground for stability, and then transported to another location where it is deposited. During such transporting of the load in the lowered position, the operator's forward line of vision is above the load so that the load and load carriage offer no obstruction. However in those types of masts where the hydraulic ram which operates the mast is centrally placed between the uprights, the ram usually obstructs the forward vision of the operator because the ram does not contract, even when the load carriage is lowered and the telescopic mast is fully contracted, to a low enough height that the operator's line of vision can pass over the top of the contracted ram. Thus the ram can cause a major blind spot in the operator's field of vision which can be especially serious in view of the congested environment of warehouse and loading dock operations.

Some mast constructions have solved this problem by utilizing a centrally located ram having a contracted height low enough to prevent obstruction of the operator's forward vision. To accomplish this objective, the ram must be designed such that the extensible end of the contracted ram is nearer to the longitudinal midpoint of the contracted mast than to the top thereof, and preferably at or below such midpoint. A major drawback of such constructions in the past is that they have required multiple, separately functioning sets of chains and sheaves within the mast structure in order to achieve the mechanical relationship necessary to extend the mast to its maximum extensibility and lift the load carriage through its maximum range of travel. Such multiple sets of chains and sheaves add substantial complexity and expense to the mast while being partially self-defeating of the visibility objective by taking up space in the mast structure which would otherwise be clear for forward viewing. For example, a two-stage mast of this type has previously been on the market which includes a first set of sheaves mounted at the extensible end of the ram over which is trained a first set of chains which interconnect the two mast sections so that, upon extension of the ram, the ram lifts one mast section relative to the other at twice the speed of extension of the ram. In addition a second set of chains, trained over a second set of sheaves at the top of the extensible mast section and interconnecting the base mast section with the load carriage, is required to move the load carriage with respect to the extensible mast section (at a rate of speed four times that of the ram). The first-mentioned set of chains must be unusually heavy in order to support the high chain loading due to the exceptionally great mechanical disadvantage of the chains relative to the load carriage.

Other types of two-stage masts have attempted to solve the visibility problem by eliminating the central location of the ram, and instead utilizing two transversely spaced rams such as shown for example in U.S. Pat. No. 4,030,568. Such structures present other types of difficulties however, particularly in that the transversely spaced rams occupy space which is otherwise needed for hydraulic hose reels and other mast accessory items, and add expense and weight as a result of the use of dual rams.

SUMMARY OF THE PRESENT INVENTION

The present invention is directed to a high visibility two-stage mast assembly for lift trucks which overcomes the above-described deficiencies by utilizing a centrally placed single hydraulic ram having a low collapsed height and yet requiring only a single set of chains and sheaves to obtain complete extension of the mast and load carriage. Such mast construction can be arranged either to provide no free lift (i.e., the extensible mast section begins to extend at the same time that the load carriage begins to rise from its lowered position), or partial free-lift (i.e., the load carriage can be raised a predetermined distance before the extensible mast section begins to extend).

To accomplish these objectives, the ram is placed centrally between the transversely spaced upright members of the two mast sections and is contractable to a length such that the top of the most extensible portion of the ram is nearer to the longitudinal midpoint of the mast than to the top thereof, and preferably is at or below such midpoint, when the mast and ram are fully contracted to provide the necessary visibility. More importantly, the means of interconnection between the ram and the extensible mast section eliminates the need for all but one set of chains and sheaves. This feature comprises a means of interconnection such that the ram begins to extend the extensible mast section, at the same speed as that of the ram, while the top of the ram remains at or near its collapsed height.

While previous two-stage masts, such as that for example shown in U.S. Pat. No. 4,030,568, feature direct lifting engagement between the top of the ram and the extensible mast section of a two-stage mast so that both extend at the same speed, such engagement begins when the top of the ram is adjacent the top of the contracted mast. Accordingly only rams of a relatively high contracted height have been used in masts featuring direct engagement of the top of the ram with the extensible mast section such that the two extend at the same speed. Rams of such high contracted height impair the operator's visibility unless paired in transversely spaced locations, which presents other disadvantages as described above. Centrally placed rams of low contracted height, on the other hand, have required an additional set of sheaves mounted at the top thereof and an additional set of chains passing over the sheaves for raising the extensible mast section at a higher speed than the speed of ram extension.

The present invention recognizes that the competing objectives of a ram having a low contracted height for good visibility, and direct engagement between the top of the ram and the extensible mast section so that the mast and ram extend at the same speed to eliminate the need for complex multiple sets of chains and sheaves, can be resolved economically and feasibly in a two-stage mast by utilizing a ram having two extensible sections and engagement means whereby the top of the ram begins lifting the extensible mast section directly, at the same speed as the ram, while the top of the ram is in the vicinity of the longitudinal midpoint of the contracted mast.

In the embodiment of the invention featuring no free-lift, this objective is accomplished by connecting the extensible end of the ram fixedly to each of the upright members of the extensible mast section at locations near the longitudinal midpoint of the extensible mast section.

In the embodiment of the mast featuring partial free-lift, the extensible end of the ram slidably, rather than fixedly, engages each of the upright members of the extensible mast section at a location adjacent the longitudinal midpoint thereof and is permitted to slide with respect to the extensible mast section through a limited distance adjacent such midpoint. In this case, a rectangular frame mounted atop the extensible end of the ram forms a "window" in the mast through which the operator's line of vision can pass unimpaired when the ram is in its contracted position.

It is therefore a principal objective of the present invention to provide a high visibility two-stage mast assembly for lift trucks which utilizes a hydraulic ram of low contracted height centrally placed between the uprights of the mast and interconnected with the mast and load carriage in such a way as to require not more than a single functional set of chains and sheaves to accomplish full extension of the mast and load carriage.

It is a further objective of the present invention to provide alternative constructions thereof providing no free-lift and partial free-lift respectively.

It is a principal feature of the invention that the hydraulic ram engages the extensible mast section to begin extending the section at the same speed as that of the ram while the extensible end of the ram is located nearer to the longitudinal midpoint of the fully contracted mast than to the top thereof.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 7 is a rear view of an exemplary embodiment of the mast of the present invention of a type providing partial free-lift.

FIG. 8 is a partially sectional top view of the mast of FIG. 7.

FIG. 9 is an exploded detail view of a portion of the mast of FIG. 7.

FIGS. 11, 12 and 13 are schematic views of the mast of FIGS. 7–10 showing sequential operation thereof.

DESCRIPTION OF THE PREFERRED EMBODIMENTS

EMBODIMENT FEATURING NO FREE LIFT

Figure 1:
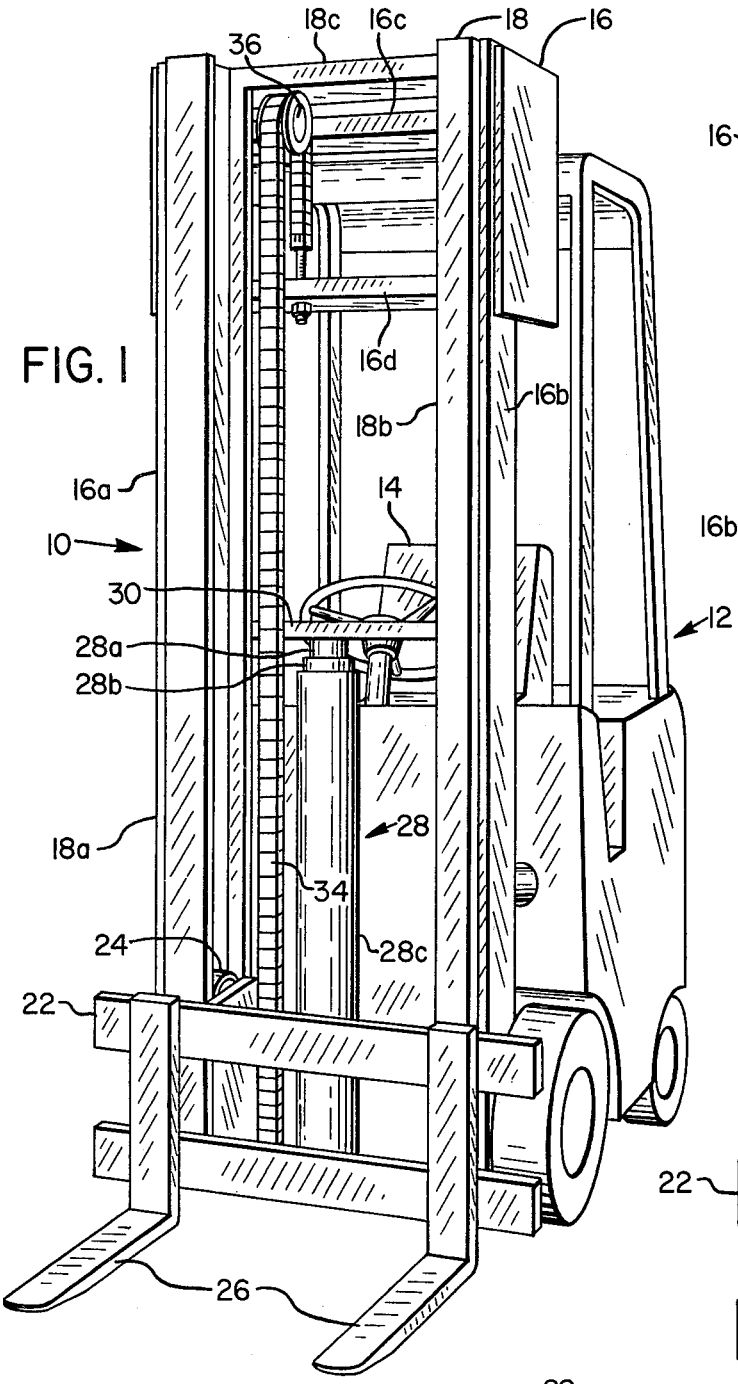
FIG. 1 depicts an exemplary embodiment of the invention providing no free-lift, mounted on a typical industrial lift truck.

In FIG. 1, an embodiment of the high visibility two-stage mast of the present invention having no free lift capability, indicated generally as 10, is shown mounted on the forward end of an exemplary industrial lift truck 12. During operation of the lift truck, the operator is positioned in the operator's seat 14 and, for forward visibility during travel, is required to look through the mast 10 between the transversely spaced upright members.

The two-stage mast 10 comprises a first, or outer mast section 16 supportably mounted upon the forward end of the truck 12, the outer mast section comprising a pair of transversely spaced apart elongate upright members **16*a* and 16b respectively, rigidly joined together by cross members 16*c*, 16*d* and 16*e*. Longitudinally and movably mounted upon the outer mast section 16 is a second, vertically extensible mast section 18 comprising a pair of transversely spaced apart elongate upright members 18*a* and 18*b* respectively, rigidly fastened together by a top cross member 18*c*. Extension of the extensible mast section 18 with respect to the outer mast section 16 is facilitated by the provision of rollers such as 20 rotatably mounted on the respective upright members 18*a* and 18*b* and engaging the inwardly facing channels of the upright members of 16*a* and 16*b*** respectively.

A load carriage 22 is movably mounted upon the extensible mast section 18 for vertical reciprocation with respect thereto. Such vertical movement is facilitated by means of rollers 24 on the carriage 22 which engage inwardly facing channels formed in the upright members **18*a* and 18*b* of the inner mast section 18. The load carriage 22 may have any of a number of different types of load handling equipment mounted thereon such as, for example, load handling forks 26**.

Figure 5:
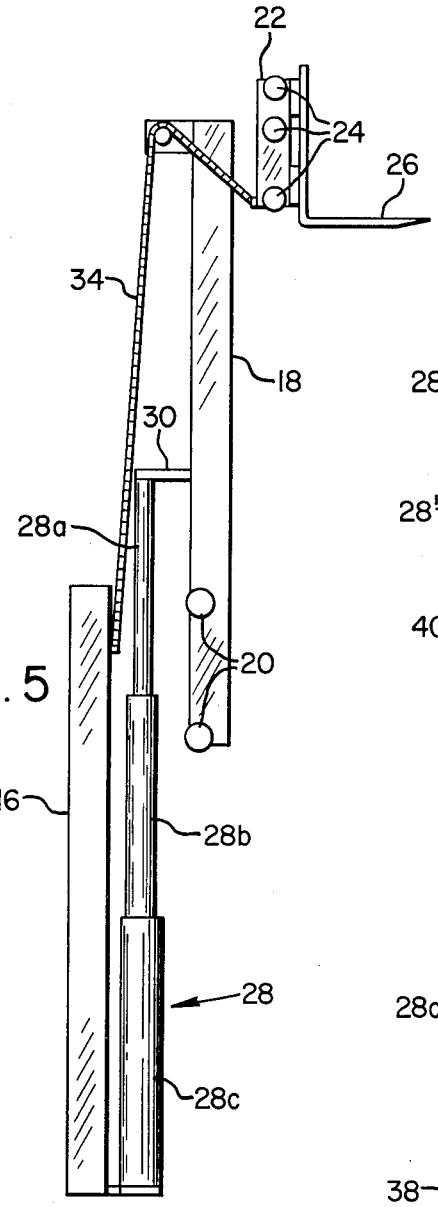
FIGS. 4 and 5 are schematic views of the mast of FIGS. 1–3, showing sequence of operation.

A fluid-actuated, extensible-contractable hydraulic ram assembly 28, having a pair of extensible elongate ram portions **28*a* and 28 *b* respectively telescopically mounted within a ram base portion 28*c*, is longitudinally mounted on the outer mast section 16 in a position transversely between the upright members 16*a* and 16*b* thereof. The mounting is accomplished by affixing of the ram base portion 28*c* to a support 16*f* mounted upon the lower cross member 16*e* of the outer mast section 16. As shown in FIG. 5, the portion 28*a* of the ram 28 is the most extensible of the ram portions 28*a* and 28*b***.

A rigid transverse member 30 is connected to the extensible end of the ram portion **28*a*, extending transversely therefrom into fixed engagement with each of the upright members 18*a* and 18*b* of the extensible mast section 18. As is depicted in the figures, the points of fixed attachment of the transverse member 30 with the upright members of the inner mast 18 are at locations nearer to the longitudinal midpoint (designated generally by line 32 in FIG. 2) of the inner mast section 18** than to the extensible end, or top, thereof. Preferably the points of attachment are no higher than such longitudinal midpoint for maximum visibility of the lift truck operator.

Figure 3:
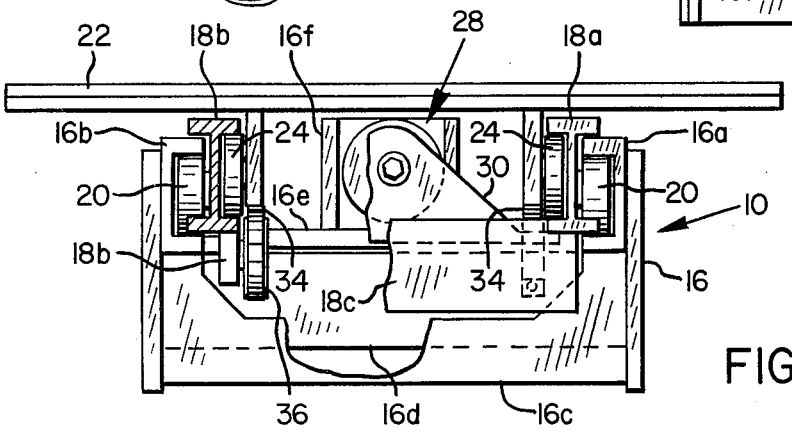
FIG. 3 is a partially sectional top view of the mast of FIG. 2.

A single set of elongated flexible tension elements such as chains 34 is anchored at one end to the outer mast section by attachment to the cross member 16*d*. The set of chains 34 passes over a pair of sheaves 36 rotatably mounted to the top of the inner mast section 18, and is connected at the opposite end to the load carriage 22. As shown in FIG. 3, the sheaves 36 extend rearwardly of the transverse member 30.

Figure 6A:
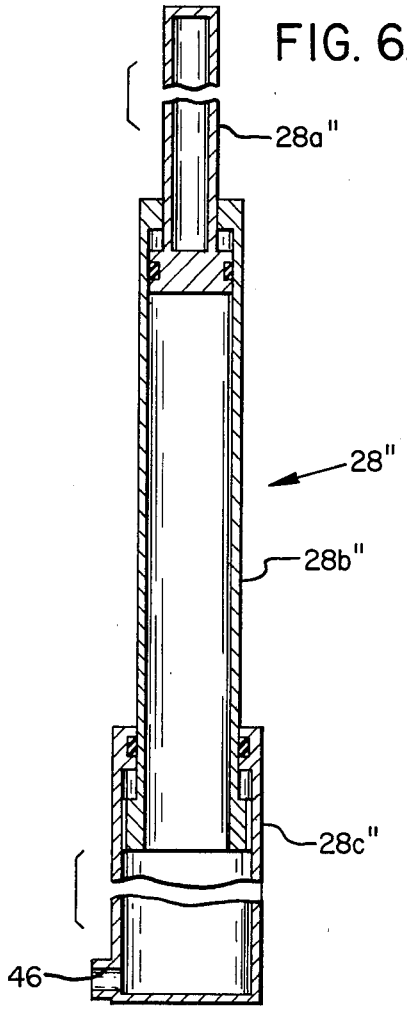
FIG. 6A is a simplified sectional view of a second type of hydraulic ram usable in the mast of the present invention.
Figure 6:
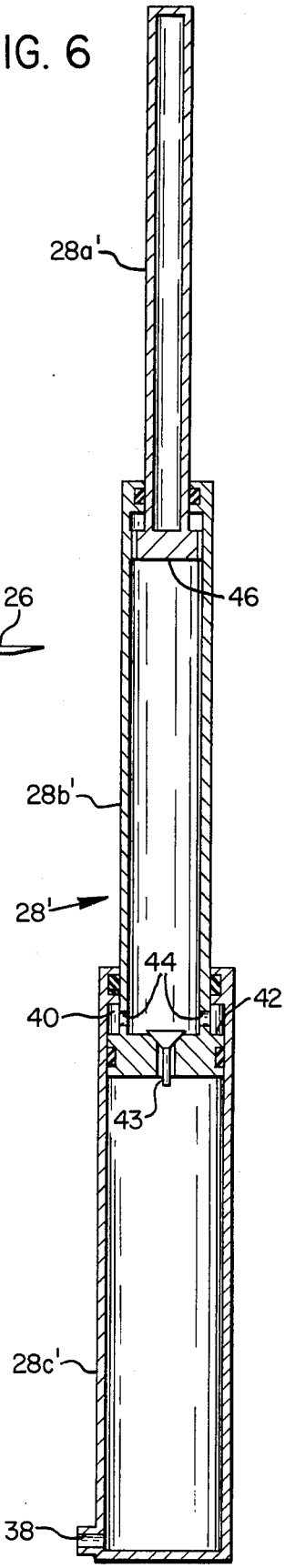
FIG. 6 is a simplified sectional view of an exemplary type of hydraulic ram usable in the mast of the present invention.

FIGS. 6 and 6*a* illustrate schematically examples of types of rams having two extensible ram portions which may be utilized as the ram 28 in the present invention. The type of ram indicated in FIG. 6 as 28' comprises two extensible portions 28*a'* and 28*b'* telescopically mounted in a base portion 28*c'*. Pressurized fluid entering the base portion 28*c'* through inlet 38 pushes against ram portion 28*c'*, thereby extending it. Simultaneously, fluid trapped in the annular sealed space 40 between the upper surface of the piston 42 of ram portion 28*b'* and the top of the base portion 28*c'* is discharged through ports 44 into the interior of ram portion 28*b'* where it pushes against portion 28*a'*, thereby simultaneously extending it. One-way check valve 43 prevents the escape of fluid under pressure from the interior of ram portion 26*b'* during its extension. If the lower area of the piston 46 of ram portion 28*a'* is substantially the same as the upper annular area of the piston 42, ram portions 28*a'* and 28*b'* extend simultaneously at substantially the same speed. During contraction, the ram portions likewise contract simultaneously.

Ram 28'', shown in FIG. 6*a*, includes extensible portions 28*a''* and 28*b''*, and a base portion 28*c''*. In this ram, pressurized fluid entering through inlet 46 first extends ram portion 28*b''* because of the greater effective surface area upon which the fluid acts. After portion 28*b''* is fully extended, the pressure of the fluid rises when acting against the smaller effective area of portion 28*a''*. Assuming that the flow rate of the pressurized fluid is constant, ram portion 28*a''* extends at a more rapid speed than portion 28*b''*. During contraction, ram portion 28*a''* contracts first, followed by ram portion 28*b''*.

Figure 2:
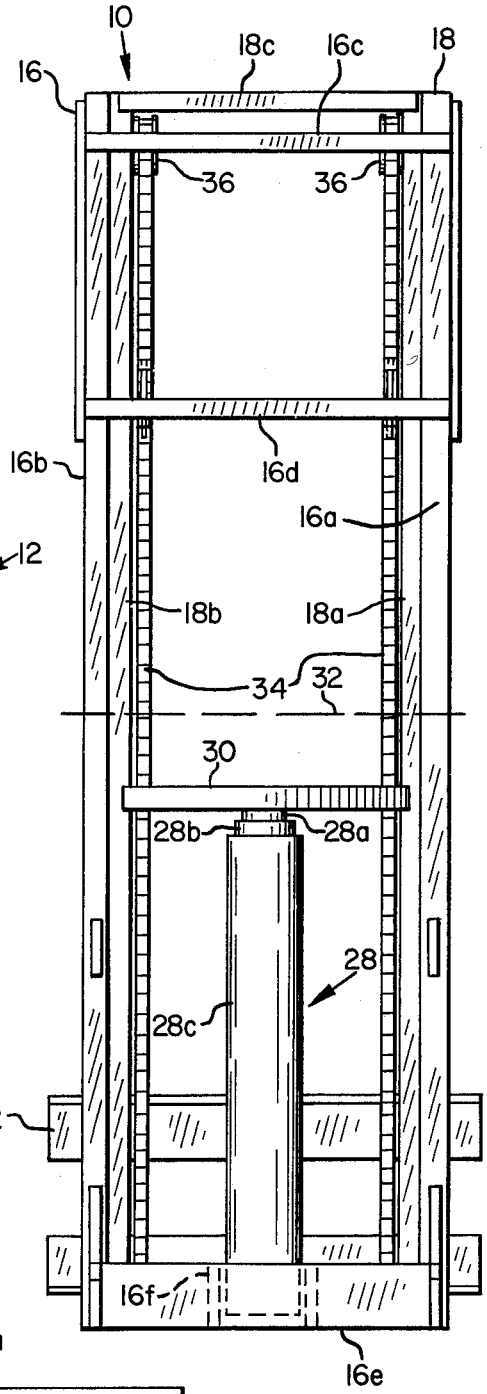
FIG. 2 is a rear view of the mast of FIG. 1.
Figure 4:
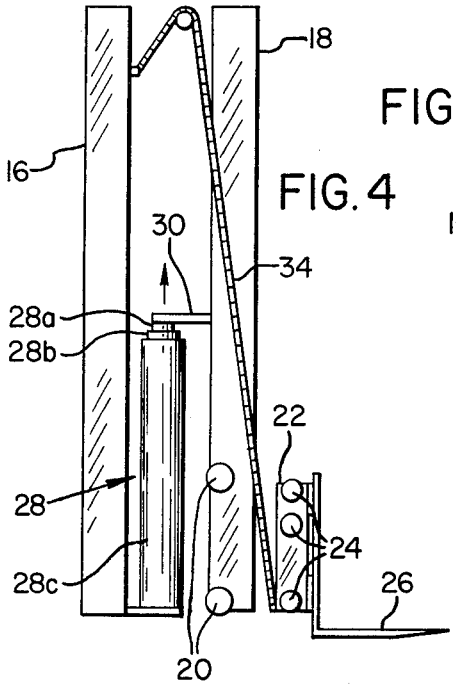

In operation, the fully contracted condition of the mast 10 and ram assembly 28 provide complete lowering of the carriage 22 as shown in FIGS. 1, 2 and 4. In such fully contracted condition, the extensible end of the ram portion 28*a* is located at a sufficiently low height that it is nearer to the longitudinal midpoint of the contracted mast (also indicated by line 32) than to the top or extensible end of the contracted mast, and preferably no higher than such midpoint, so as to provide an unobstructed view between the upright members of the mast at operator eye level. Upon the introduction of pressurized fluid into the base section 28*c* of the ram 28, the ram immediately begins extending the mast section 18 at the same speed as the speed of extension of the ram by virtue of the fixed connection between the extensible end of the ram 28, through the transverse member 30, with the inner mast section 18. Such extension of the mast section 18 begins while the ram 28 remains substantially in its fully contracted condition as shown in FIG. 4. During extension, inner mast section 18 rises at the same speed as the speed of extension of ram 28, while the carriage 22 rises at twice that speed by virtue of the lifting force exerted on the carriage by chains 34. Full extension is depicted in FIG. 5. If the speed of extension of ram 28 is constant, as for example if a ram such as that shown in FIG. 6 is used, the lifting speed of carriage 22 is also constant throughout its range of travel. Lowering of the carriage 22 involves the reverse of the aforementioned sequence.

EMBODIMENT FEATURING PARTIAL FREE-LIFT

FIGS. 7–13 depict an alternative construction of the invention which provides partial free-lift of the load carriage; that is, the load carriage may be raised a predetermined distance from its lowered position without necessitating any extension of the inner mast section. To facilitate understanding, parts of this embodiment which correspond to those of the previously described embodiment have been assigned the same reference characters with the number 100 added thereto.

With reference to FIGS. 7 and 8, the two-stage mast 110 comprises a first, or outer, mast section 116 for mounting upon the forward end of a lift truck, the mast section 116 comprising a pair of transversely spaced apart upright members 116*a* and 116*b* respectively rigidly joined together by cross members 116*c*, 116*d* and 116*e*. Movably mounted upon the outer mast section 116 is a second, vertically extensible mast section 118 comprising a pair of transversely spaced apart elongate upright members 118*a* and 118*b* rigidly fastened together by a top cross member 118*c*. Rollers 120 mounted on the upright members 118*a*, 118*b* facilitate extension of the extensible mast section 118 with respect to the outer section 116. A load carriage 122 is movably mounted upon the extensible mast section 118 for vertical reciprocation with respect thereto, such reciprocation being facilitated by means of rollers 124.

A fluid-actuated, extensible-contractable ram assembly 128, which may be identical in all respects to ram 28 of the previous embodiment, has a pair of extensible ram portions 128*a* and 128*b* respectively telescopically mounted within a ram base portion 128*c* which in turn is mounted on the outer mast section 116 by means of support 116*f* in a position transversely between the upright members 116*a* and 116*b*.

Figure 10:
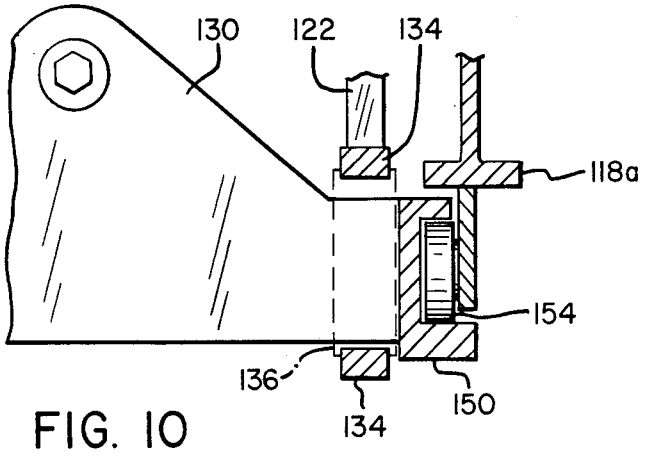
FIG. 10 is an enlarged sectional view taken along line 10—10 of FIG. 7.

A rigid transverse member 130 is connected to the top of the most extensible ram portion 128*a*, extending transversely therefrom toward each of the upright members 118*a* and 118*b* of the extensible mast section 118. Rather than being fixedly attached to the upright members 118*a* and 118*b* however, as in the previous embodiment, the transverse member 30 is instead rigidly attached to a pair of transversely spaced vertical members 150 and 152 respectively as shown in FIG. 9. A cross member 156 joins the two vertical members 150 and 152 rigidly together at the top thereby completing, in conjunction with the vertical members 150 and 152 and the transverse member 130, a rectangular window-like frame designated generally as 157. The vertical members 150 and 152 are movably mounted upon the upright members 118*a* and 118*b* of the extensible mast section 118 so as to move longitudinally with respect to the extensible mast section. As shown in FIGS. 9 and 10, such movable mounting is accomplished through the interaction of rollers 154, mounted on the upright members 118*a* and 118*b* respectively, with the outwardly facing channels of the vertical members 150 and 152 respectively. The cross member 118*c* of the extensible mast section 118 is located directly above the tops of the vertical members 150 and 152 so as to limit the longitudinal movement of the frame 157 with respect to the extensible mast section 118.

Mounted on the inner surfaces of the vertical members 150 and 152 respectively is a set of rotatable sheaves 136 having a set of lifting chains 134 passing over them. One end of the set of chains 134 is anchored to the cross member 116*d* of the outer mast section 116, while the other end of the set is connected to the load carriage 122.

In operation, the fully contracted condition of the mast 110 and ram assembly 128 provide complete lowering of the carriage 122 as shown in FIGS. 7 and 11. As in the previous embodiment, in such fully contracted condition the extensible end of the ram portion 128*a* is located at a sufficiently low height that it is nearer to the longitudinal midpoint, designated by the line 132 in FIG. 7, of the contracted mast 110 than to the top or extensible end thereof, and preferably is located no higher than such longitudinal midpoint. This, coupled with the window-like frame 157 extending upwardly from ram portion 128*a* to support sheaves 136, provide an unobstructed view between the upright members of the mast at operator eye level.

Upon the introduction of pressurized fluid into the base section 128*c* of the ram 128, the ram begins to lift the frame 157 with respect to the extensible mast section 118, without thereby also lifting this mast section. During this initial extension of the ram 128, the carriage 122 is raised at twice the speed of extension of the ram by means of chains 134. This "free-lift" portion of the operation continues only through a relatively short distance of ram extension, and terminates when the ram, carriage and frame 157 are in the positions indicated by the dotted lines in FIG. 11. At this point, the top of the frame 157 abuts against the lower surface of cross member 118*c* of the extensible mast section 118 and begins extending mast section 118 at the same speed as the speed of extension of the ram. It will be noted that such extension of the mast section 118 begins while the extensible end of the ram portion 128*a* remains nearer to the longitudinal midpoint of the fully contracted mast than to the top, or extensible end, of the contracted mast.

Figure 12:
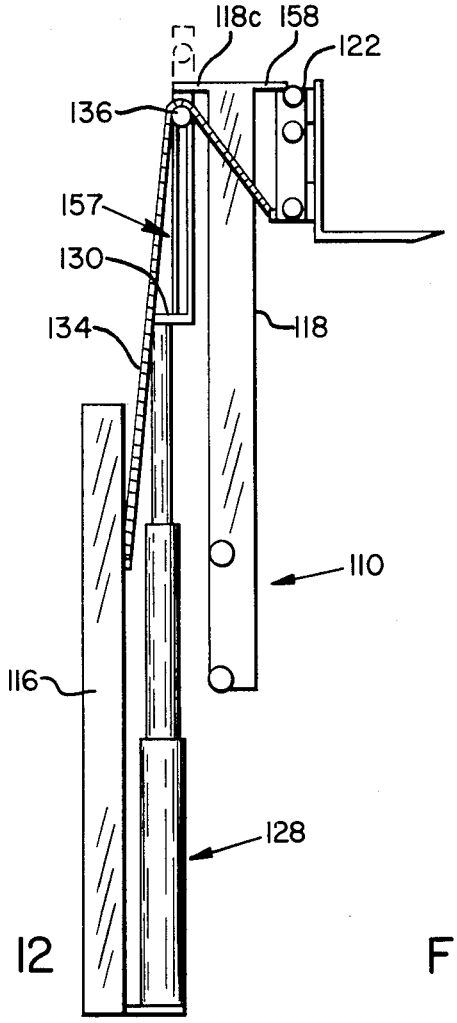
Figure 13:
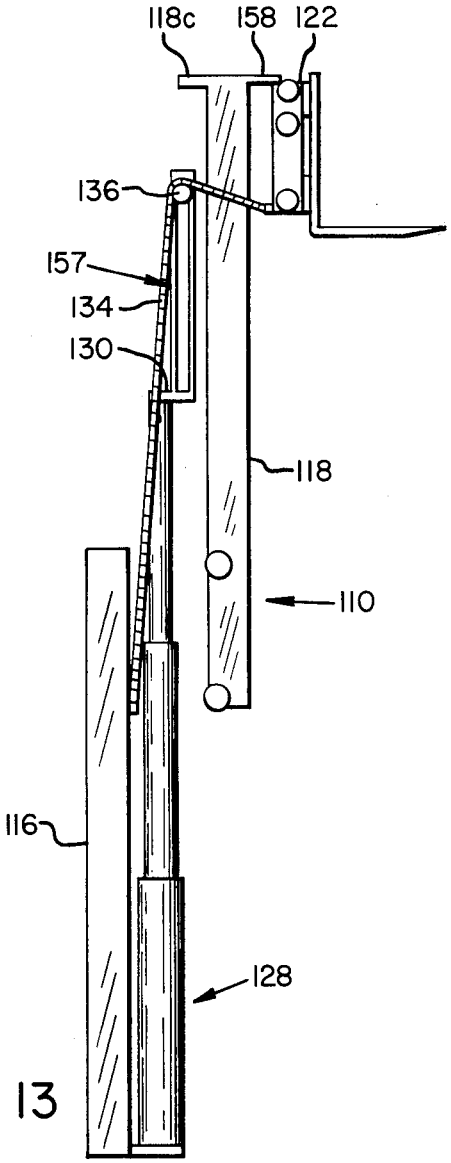

With reference to FIG. 12, continued extension of the ram 128 causes the extensible mast section 118 to rise at the same speed as the speed of ram extension, while the carriage 122 rises at twice that speed. Ultimately the carriage 122 abuts against a stop, indicated schematically as 158, on the mast section 118. This occurs before the ram 128 is fully extended, and accordingly further extension of the ram continues to lift the carriage 122 at twice the speed of ram extension, thereby lifting mast section 118 simultaneously and disengaging cross member 118*c* from the top of frame 157. When the carriage 122 is lowered, the reverse of the aforementioned sequence occurs.

It should be mentioned that it is possible, within the scope of the present invention, to accomplish a result somewhat equivalent to the above-described partial free lift without necessarily providing for relative vertical movement between the top of the ram assembly and the extensible mast section. Since the object of free lift is to permit some raising of the load carriage without a corresponding increase in the overall height of the mast to facilitate operation in areas of overhead height restrictions such as railway boxcars, it is possible, for example, to achieve this result by employing a structure such as the embodiment of FIGS. 1–5 wherein the top of the extensible mast section is below the top of the outer mast section when the mast is fully contracted. Thus the load carriage could be raised a limited distance simultaneously with the initial extension of the inner mast section before the top of the inner mast section could extend above the top of the outer section. In such alternative structure the inner mast section could simply be shorter than the outer section or, preferably, both sections could be the same length with the bottom of the inner section extending below the bottom of the outer section in the fully contracted condition. In all other respects, structure and operation of this type of mast would be similar to that of FIGS. 1–5 and would incorporate the invention herein.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A high-visibility load-lifting structure for an industrial lift truck or the like comprising an elongate, extensible-contractable telescopic mast having an extensible end, said mast including a first elongate mast section for mounting vertically on said truck and a second elongate mast section longitudinally and movably mounted upon said first mast section for vertical extension therefrom, each of said mast sections having a top and comprising a pair of transversely-spaced apart elongate upright members, a load carriage movably mounted upon said second mast section and extending forwardly therefrom for vertical reciprocation with respect thereto along a predetermined vertical path of travel, and a fluid-actuated, extensible-contractable fluid ram assembly comprising multiple relatively reciprocable elongate ram portions for selectively moving said load carriage and said second mast section with respect to said first mast section, said ram portions being telescopically longitudinally mounted on said first mast section in a position transversely between the upright members thereof, a first one of said ram portions having an extensible end which is more extensible in a longitudinal direction than any other of said ram portions, the extensible end of said first ram portion being located nearer to the longitudinal midpoint of said mast than to the extensible end thereof when said mast and ram assembly are fully contracted, a rigid transverse member connected to the extensible end of said first ram portion extending transversely therefrom and fixedly attached to each of the upright members of said second mast section at locations rearwardly of said predetermined vertical path of travel of said load carriage so as to avoid interference with the vertical reciprocation thereof, a pair of transversely-spaced sheaves rotatably mounted adjacent the top of said second mast section above said transverse member and extending rearwardly of said transverse member, and a pair of elongated flexible tension elements trained over said respective sheaves, each tension element being connected at one end to said first mast section and at the other end to said load carriage, said first ram portion engaging said second mast section during extension of said ram assembly from its fully-contracted position in such a manner as to begin extending said second mast section at the same speed as that of said ram assembly while the extensible end of said first ram portion remains nearer to the longitudinal midpoint of the fully-contracted mast than to the extensible end thereof.

2. The load lifting structure of claim 1 wherein said ram assembly comprises a base portion and a pair of said ram portions telescopically extensible from said base portion.

3. The load lifting structure of claim 1 wherein the extensible end of said first ram portion is located no higher than the longitudinal midpoint of said mast when said mast and ram assembly are fully contracted.

4. A high-visibility load-lifting structure for an industrial lift truck or the like comprising an elongate, extensible-contractable telescopic mast having an extensible end, said mast including a first elongate mast section for mounting vertically on said truck and a second elongate mast section longitudinally and movably mounted upon said first mast section for vertical extension therefrom, each of said mast sections having a top and comprising a pair of transversely-spaced apart elongate upright members, a load carriage movably mounted upon said second mast section for vertical reciprocation with respect thereto, and a fluid-actuated, extensible-contractable fluid ram assembly comprising multiple relatively reciprocable elongate ram portions for selectively moving said load carriage and said second mast section with respect to said first mast section, said ram portions being telescopically longitudinally mounted on said first mast section in a position transversely between the upright members thereof, a first one of said ram portions having an extensible end which is more extensible in a longitudinal direction than any other of said ram portions, the extensible end of said first ram portion being located nearer to the longitudinal midpoint of said mast than to the extensible end thereof when said mast and ram assembly are fully contracted, and a rigid transverse member connected to the extensible end of said first ram portion extending transversely therefrom toward each of the upright members of said second mast section and movably engaging each of the upright members of said second mast section so as to move longitudinally with respect thereto, said transverse member having a pair of transversely-spaced apart elongate vertical members extending longitudinally from each end thereof toward the extensible end of said mast defining a window-like space bounded on the bottom by said transverse member and on the sides by said vertical member, said vertical members also being longitudinally movable with respect to said second mast section, further including a member located adjacent the top of said second mast section for engaging said vertical members and thereby limiting the longitudinal movement of said transverse member and vertical members relative to said second mast section.

5. The load-lifting structure of claim 4 including flexible lifting means interconnecting said first mast section and said load carriage for lifting said load carriage in response to extension of said fluid ram assembly, and sheave means mounted upon said vertical members so as to move in unison with said vertical members for movably engaging said flexible lifting means.

6. The load-lifting structure of claim 4 wherein said member located adjacent the top of said second mast section is positioned so that, during extension of said ram assembly from its fully-contracted position, said ram assembly begins extending said second mast section at the same speed as that of said ram assembly while the extensible end of said first ram portion remains nearer to the longitudinal midpoint of the fully-contracted mast than to the extensible end thereof.

7. The load-lifting structure of claim 4 wherein the extensible end of said first ram portion is located no higher than the longitudinal midpoint of said mast when said mast and ram assembly are fully contracted.

* * * * *

UNITED STATES PATENT AND TRADEMARK OFFICE

CERTIFICATE OF CORRECTION

PATENT NO. : 4,191,276

DATED : March 4, 1980

INVENTOR(S) : Stanley E. Farmer and Harlan D. Olson

It is certified that error appears in the above-identified patent and that said Letters Patent are hereby corrected as shown below:

Col. 4, line 34 Change "members of 16a" to --members 16a--.

Col. 5, line 16 Change "28c;" to --28b;--.

Signed and Sealed this

*Seventeenth* Day of *June 1980*

[SEAL]

*Attest:*

SIDNEY A. DIAMOND

*Attesting Officer*

*Commissioner of Patents and Trademarks*